US006634030B2

(12) United States Patent
Park

(10) Patent No.: US 6,634,030 B2
(45) Date of Patent: Oct. 21, 2003

(54) CAP WITH A PATTERN MOLD SHEET

(75) Inventor: Boo YL Park, Seoul (KR)

(73) Assignee: DADA Corp., Seoul (KR)

( * ) Notice: Subject to any disclaimer, the term of this patent is extended or adjusted under 35 U.S.C. 154(b) by 0 days.

(21) Appl. No.: 09/986,151

(22) Filed: Nov. 7, 2001

(65) Prior Publication Data

US 2003/0084499 A1 May 8, 2003

(51) Int. Cl.[7] ..... A42B 1/00
(52) U.S. Cl. ..... 2/195.6; 2/195.1
(58) Field of Search ..... 2/195.6, 171, 209.12, 2/209.3, 200.1, 195.1, 175.1

(56) References Cited

U.S. PATENT DOCUMENTS

| | | | | | |
|---|---|---|---|---|---|
| 1,115,043 | A | * | 10/1914 | Waring | 2/171 |
| 3,128,474 | A | * | 4/1964 | Feldman | 2/195.6 |
| 3,766,565 | A | * | 10/1973 | Cozzens | 2/209.7 |
| 4,222,125 | A | * | 9/1980 | Sewell-Wood | 2/195.1 |
| 4,270,229 | A | * | 6/1981 | Lipschutz | 2/195.1 |
| 4,549,316 | A | * | 10/1985 | Johnson | 2/195.1 |
| 4,606,077 | A | * | 8/1986 | Phillips | 2/209.3 |
| 4,776,043 | A | | 10/1988 | Coleman | |
| 4,873,726 | A | | 10/1989 | Tapia | |
| 4,982,449 | A | * | 1/1991 | Finkelstein | 2/200.1 |
| 5,136,726 | A | | 8/1992 | Kellin et al. | |
| 5,241,919 | A | | 9/1993 | LaGreca | |
| 5,817,393 | A | | 10/1998 | Stahl | |
| 5,832,537 | A | * | 11/1998 | Wakefield, III | 2/195.1 |
| 5,832,854 | A | | 11/1998 | Lin et al. | |
| 5,947,044 | A | | 9/1999 | Lin et al. | |
| 5,983,400 | A | * | 11/1999 | Kronenberger | 2/209.13 |
| 6,076,192 | A | * | 6/2000 | Kronenberger | 2/195.6 |
| 6,158,055 | A | | 12/2000 | Park | |
| 6,370,696 | B1 | * | 4/2002 | Kronenberger | 2/175.1 |

* cited by examiner

*Primary Examiner*—Rodney M. Lindsey
(74) *Attorney, Agent, or Firm*—Jacobson Holman PLLC

(57) ABSTRACT

A cap with a pattern mold sheet including a crown main body formed by a plurality of panels, and a visor portion that is secured to a forward edge of the crown and which extends outwardly therefrom. In order to give an improved three-dimensional effect to a desired pattern such as logos, symbols, or emblems which a user wants, the pattern mold sheet is used which heightens the three-dimensional effect as compared with the traditional use of embroidery threads. The pattern mold sheet is formed with a three-layer structure including an upper stretchable fabric material or polyurethane, a sponge and a lower fabric material. The pattern mold sheet is formed by heating a sheet with the heater and pressing the mold frame with the shape of the pattern and the size of the sheet a user wants on the heated sheet with a compressor. The level of the pattern can be differently represented on the pattern mold sheet by varying the depth of the inner part of the mold frame, thus heightening the three-dimensional effect.

8 Claims, 3 Drawing Sheets

CAP WITH A PATTERN MOLD SHEET

BACKGROUND OF THE INVENTION

1. Field of the Invention

The present invention relates generally to a cap design and, more particularly, to an improved shape of a cap made to produce a natural three-dimensional effect by using a pattern mold sheet presenting patterns instead of existing embroidery threads, which also provides variety by adjusting the level of patterns such as logos, symbols, emblems, letters, numbers and diagrams as desired by a company, person, or organization.

2. Description of the Prior Art

Conventional baseball style caps are generally comprised of a crown main body formed by a plurality of panels, and a visor portion that is secured to a forward edge of the crown and extends outwardly therefrom. Typically, patterns such as logos, symbols, emblems, letters, numbers and diagrams that a company, a person or an organization wants are displayed on such caps. Since plain and simple patterns presented only with embroidery threads often do not satisfy customers' aesthetic wants, three-dimensional embroidery designs have been a recent trend.

Three-dimensional embroidery designs can be presented by adding two or more embroidery layers to an existing plane embroidery layer. However, the higher the embroidery layers grow, the more difficult it becomes to insert an embroidery needle into the fabric material, resulting in both reduced work efficiency, and increased cost due to the additional amount of embroidery thread being used.

To overcome such problems, a method of attaching a mold material made of soft polyethylene resin to a fabric material and stitching it with embroidery threads has been developed. Such a method, however, reduces both work and production efficiency, for additional embroidery work is needed to determine the position of the soft mold material and special attention must be paid to the process of manually attaching the soft mold material to the fabric material.

Another method has been developed for acquiring three-dimensional patterns projected on the surface by attaching a sheet to the surface of a fabric material and stitching both the fabric material and the sheet together, and then removing the residues not stitched along the tier lines formed as dots by embroidery needles during stitching. This method, however, has not completely eliminated defects such as naps on the stitched sheet caused in the process of representing three-dimensional patterns.

SUMMARY OF THE INVENTION

Therefore, it is a primary object of the present invention to provide a cap structure that represents an improved three-dimensional effect without a nap on the surface of a sheet by using an additional pattern mold sheet in place of existing embroidery threads.

It is another object of the present invention to represent various kinds of three-dimensional effects by adjusting the level of the patterns.

In order to achieve the foregoing objects, the present invention provides an improved cap structure comprising a crown main body formed of a plurality of panels, with a visor portion secured to a forward edge of the crown and extending outwardly therefrom. The pattern mold sheet is formed to be of a size suitable for placement on the visor portion and is attached to another fabric material. The structure of the pattern mold sheet is generally composed of an upper stretchable fabric material or polyurethane, a sponge in the middle, and a lower fabric material.

The above pattern mold sheet is formed by the process of heating a sheet with a heater and pressing a mold frame manufactured beforehand with the shape of a pattern on the heated sheet with a compressor.

DETAILED DESCRIPTION OF THE PREFERRED EMBODIMENTS

Figure 1:
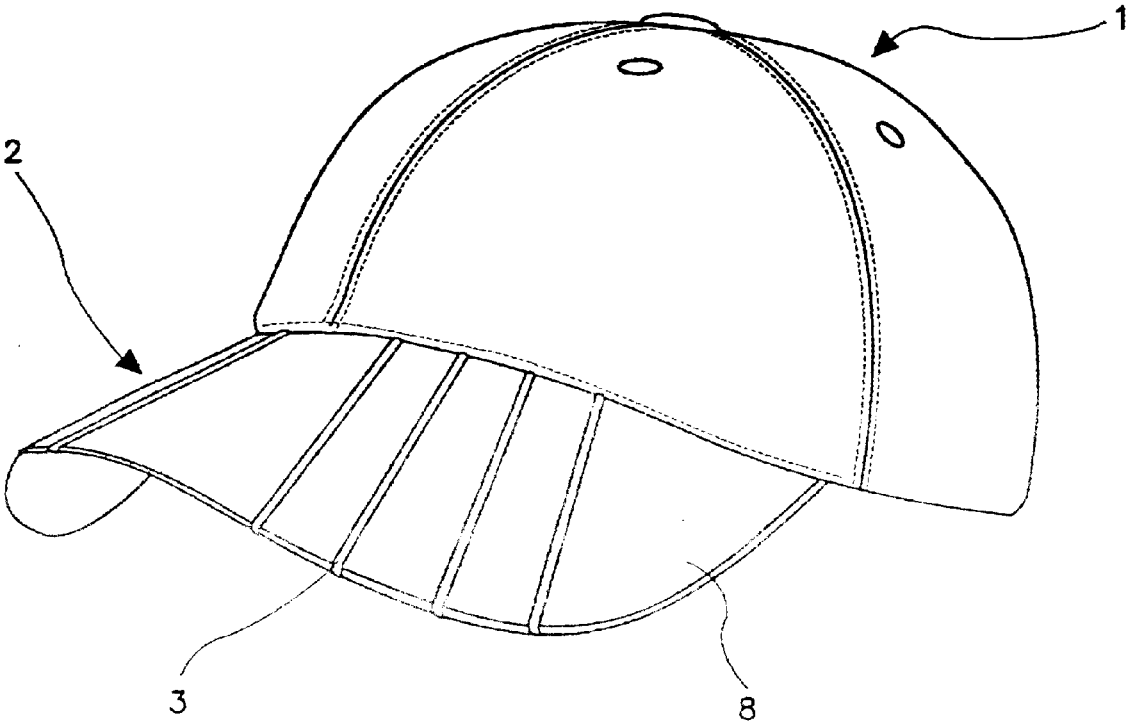
FIG. 1 is a perspective view of the cap with a pattern mold sheet according to the present invention.

In accordance with a preferred embodiment of the present invention, and with particular attention to FIG. 1, the cap with a pattern mold sheet includes a crown 1 which is fabricated with a plurality of fabric segments, and a visor portion 2 that is secured to a forward edge of the crown and extends outwardly therefrom. The mold sheet 8, which in this embodiment is represented as a pattern of straight lines 3, is attached to the visor portion. Unlike three-dimensional patterns represented with existing embroidery threads, with the present invention it is possible to create improved three-dimensional effects without attaching lines. Moreover, the straight line pattern 3 represented on the pattern mold sheet 8 completely eliminates the defect of raising a nap which is encountered with existing attached sheets.

Figure 2:
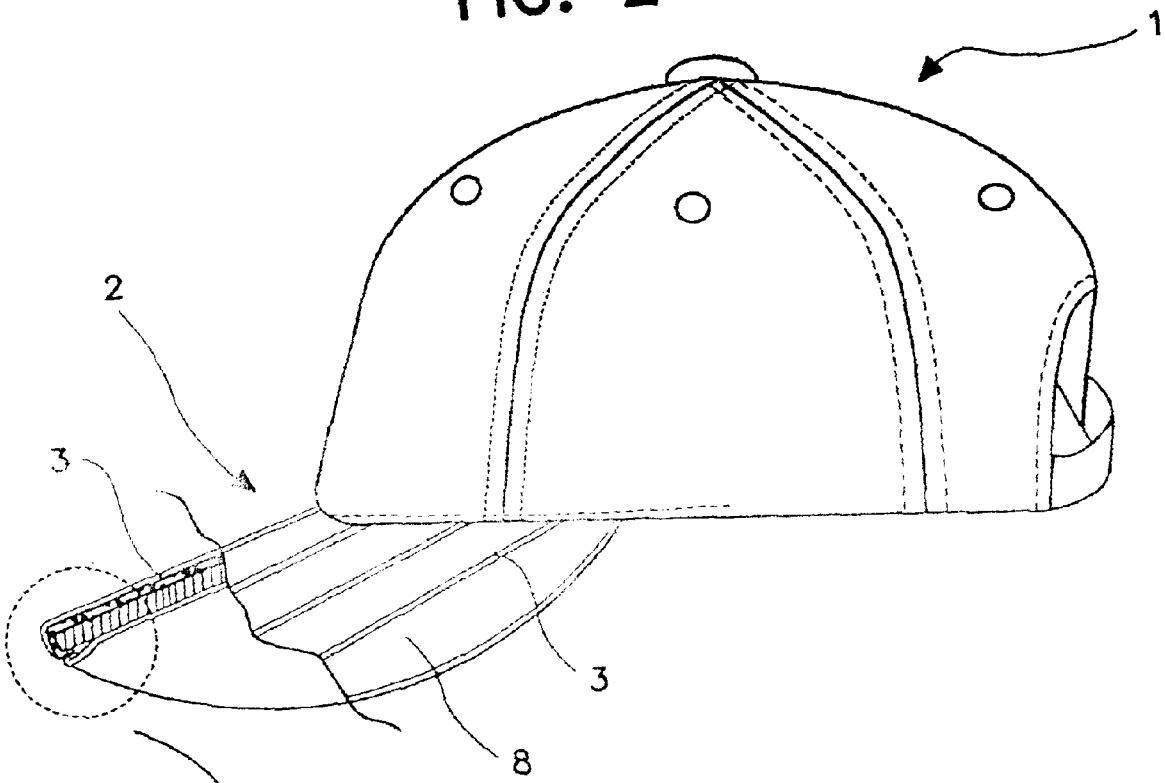
FIG. 2 is a right cross-sectional view of the cap with a pattern mold sheet of FIG. 1.
Figure 2A:
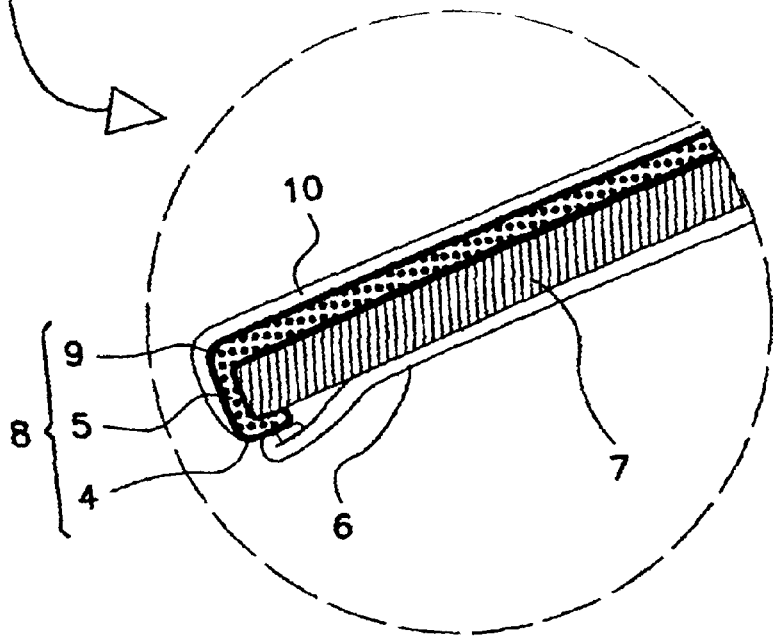
FIG. 2A is an enlarged view of the circled portion of FIG. 2.

FIG. 2 is a side view of the cap according to the present invention with a partial cross-sectional view which is shown in greater detail on FIG. 2A. As illustrated in the drawings, the mold sheet 8 representing the straight line pattern 3 is attached to the visor portion 2 that is secured to a forward edge of the crown. Generally, the visor portion 2 is comprised of a soft or hard visor material 7 in the middle, the pattern mold sheet B attached to the visor material 7, a general upper fabric material 10, which covers an upper surface of the pattern mold sheet 8, and a general lower fabric material 6, which covers the lower part of the visor material 7. The visor portion 2 formed with the above pattern mold sheet is manufactured by using the mold sheet 8 embodying the pattern 3 instead of only using the general upper fabric material 10 and thereby covering the soft or hard visor material 7 of a fixed thickness together with the general lower fabric material 6.

Though not illustrated in the drawing, it is possible to apply the three-dimensional pattern mold sheet to the crown by using the above pattern mold sheet in place of the plurality of fabric segments comprising the crown.

Figure 4:
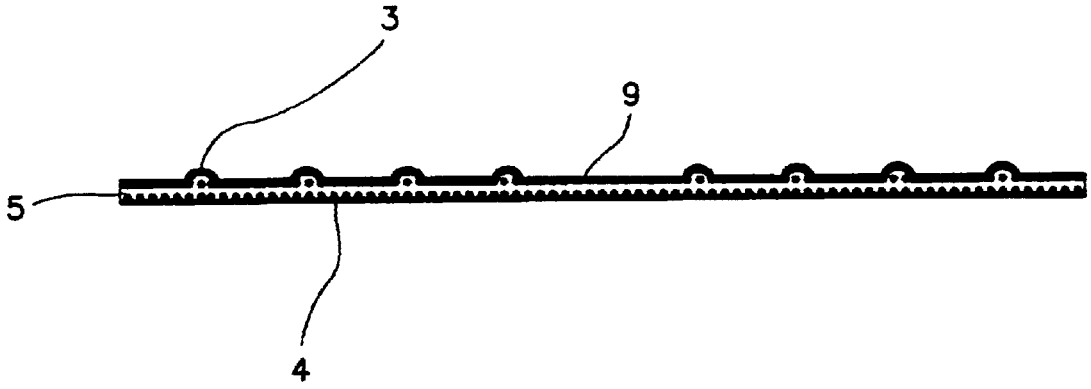
FIG. 4 is a partial cross-sectional view taken on line IV—IV of FIG. 3.
Figure 3:
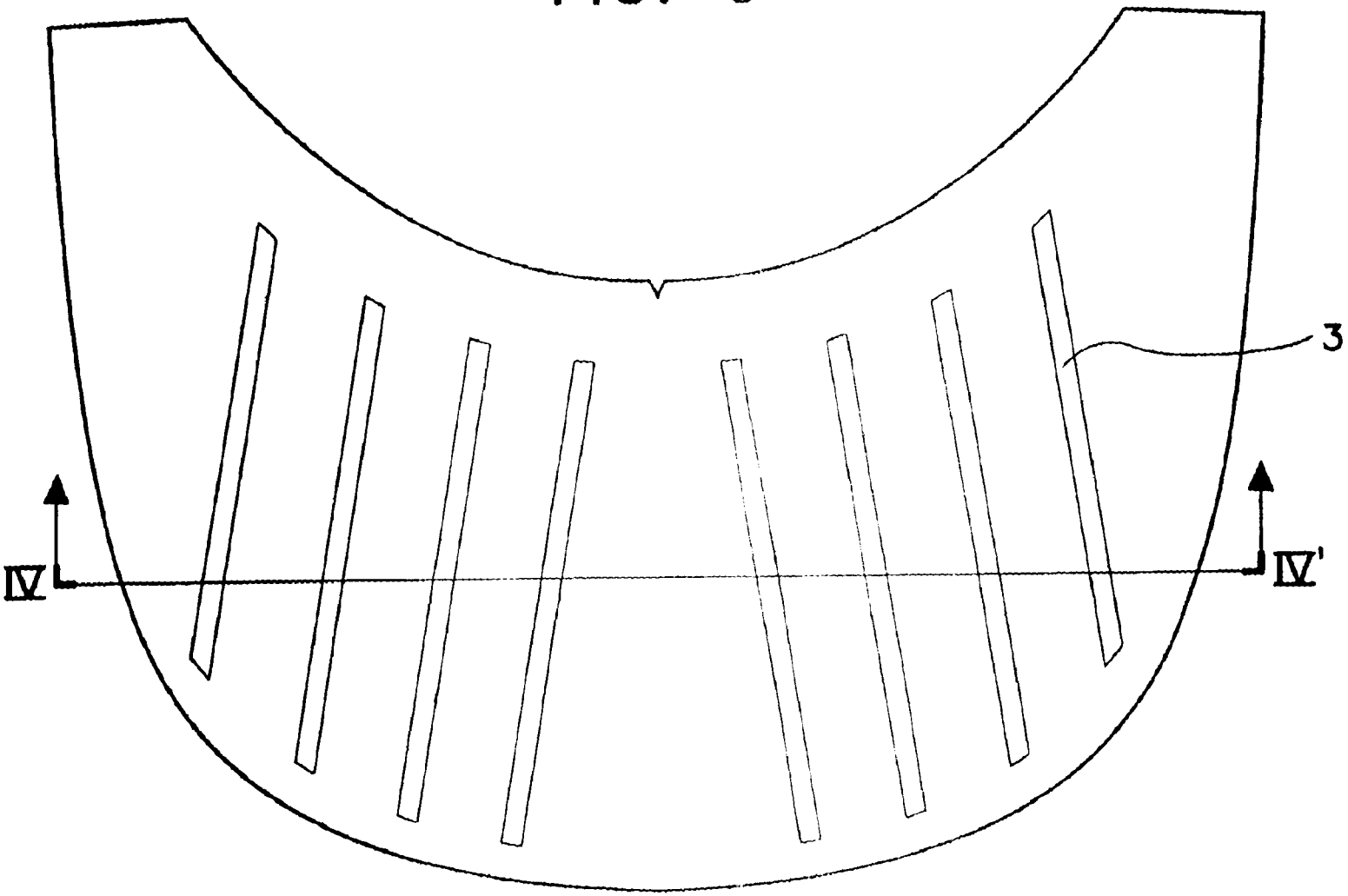
FIG. 3 is a plane view of a pattern mold sheet.

FIG. 3 is a plane view of the pattern mold sheet. As illustrated in the drawing, the pattern mold sheet 8 is formed to have the same size as the fabric material used to manufacture the general material portion that is used to cover the visor. FIG. 4 is the partial cross-sectional view on line IV—IV of FIG. 3. As illustrated in the drawing, the pattern mold sheet is composed of the upper stretchable fabric material 9, a sponge 5 in the middle and a lower fabric material 4. Polyurethane can be used as a substitute for the upper stretchable fabric material 9 or for the lower fabric material 4. The pattern mold sheet representing the above pattern 3 is manufactured by the process of forming the mold frame with the shape of the pattern and in the size of the sheet that a user wants in advance and then heating the sheet with a heater and pressing the mold frame on the heated sheet with a compressor.

If the depth of the inner part of a mold frame is made to vary, the level of the pattern can be differently represented on the pattern mold sheet, i.e., different parts of the pattern may be made to project to different degrees, heightening the three-dimensional effect.

It will be apparent to those skilled in the art that various modifications and variations can be made in the present invention without deviating from the spirit or scope of the invention. Thus, it is intended that the present invention cover the modifications and variations of this invention provided they come within the scope of the appended claims and their equivalents.

What is claimed is:

1. A baseball style cap with a pattern mold sheet comprising:

a crown main body having a plurality of panels;

a visor portion that is secured to a forward edge of said crown and extends outwardly therefrom;

said visor being composed of the pattern mold sheet, a visor material formed under the pattern mold sheet, a general upper fabric material covering the pattern mold sheet and a general lower fabric material lining an underside of said visor material, said pattern mold sheet being formed with a three-layer structure including an upper fabric material, a lower fabric material, and a spongy material between said upper and lower fabric materials.

2. The baseball style cap as claimed in claim 1, wherein said visor material is formed of a soft material.

3. The baseball style cap as claimed in claim 1, wherein said visor material is formed of a hard material.

4. The baseball style cap as claimed in claim 1, wherein said upper fabric material is formed of a stretchable fabric material.

5. The baseball style cap as claimed in claim 1, wherein said upper fabric material is formed of polyurethane.

6. A baseball style cap with a pattern mold sheet, comprising:

a main body having a plurality of panels forming a crown portion;

a visor portion secured to a forward edge of the crown portion and extending outwardly therefrom;

at least one of said plurality of panels formed of the pattern mold sheet, said pattern mold sheet being formed with a three-layer structure including an upper fabric material, a lower fabric material and a sponge between said upper and lower fabric materials.

7. The baseball style cap as claimed in claim 6, wherein the upper fabric material of said pattern mold sheet is formed of a stretchable fabric material.

8. The baseball style cap as claimed in claim 6, wherein the upper fabric material of said pattern mold sheet is formed of polyurethane.

* * * * *